US005377834A

United States Patent [19]

Müller et al.

[11] Patent Number: 5,377,834

[45] Date of Patent: Jan. 3, 1995

[54] DISPENSER PACKAGE FOR LIGHT-SENSITIVE PRODUCTS

[75] Inventors: Frank Müller, Rengsdorf; Peter Weckwarth, Solingen; Hans-Uwe Richter, Wuppertal, all of Germany

[73] Assignee: Lohmann GmbH & Co. KG, Neuwied, Germany

[21] Appl. No.: 103,391

[22] Filed: Aug. 2, 1993

[30] Foreign Application Priority Data

Jul. 31, 1992 [DE] Germany ..... 4225347

[51] Int. Cl.[6] ..... B65D 85/62

[52] U.S. Cl. ..... 206/455; 206/494; 220/463; 229/137

[58] Field of Search ..... 229/137; 220/403, 461, 220/462, 463; 206/494, 491, 492, 455

[56] References Cited

U.S. PATENT DOCUMENTS

| | | | |
|---|---|---|---|
| 3,955,743 | 5/1976 | Tanneberger . | |
| 4,667,873 | 5/1987 | Yasui et al. | 229/137 |
| 4,730,770 | 3/1988 | Walton | 229/137 X |
| 4,911,306 | 3/1990 | Lisiecki et al. | 229/137 X |
| 5,176,313 | 1/1993 | Curry et al. | 229/137 X |

FOREIGN PATENT DOCUMENTS

| | | |
|---|---|---|
| 1596025 | 7/1970 | France . |
| 1148936 | 3/1963 | Germany . |
| 259280 | 6/1949 | Switzerland . |
| 769941 | 3/1957 | United Kingdom . |

*Primary Examiner*—Paul T. Sewell
*Assistant Examiner*—Jacob K. Ackun, Jr.
*Attorney, Agent, or Firm*—Herbert Dubno

[57] ABSTRACT

A dispenser package for a light-sensitive product, having an erectable outer box and a tubular protective foil received in the box and containing the product, the box includes a lower panel, an upper panel, two substantially parallel side panels connecting the upper and lower panels along opposite longitudinal edges thereof, and respective inwardly foldable end flaps at opposite ends of the box and at each side panel, the end flaps have respective segments foldable along a plurality of folding lines, so that a light sensitive product can be dispensed therein without a detrimental effect on a quality of the product upon opening and subsequent closing of the package.

12 Claims, 6 Drawing Sheets

DISPENSER PACKAGE FOR LIGHT-SENSITIVE PRODUCTS

FIELD OF THE INVENTION

The present invention relates to a dispenser package for light-sensitive products and, more particularly, to a dispenser package which comprises an erectable box and a tubular foil which is received in the box and which, in turn, receives the material, usually sheet material, to be dispensed.

BACKGROUND OF THE INVENTION

It is known, e.g. from DE-AS 11 48 936, for example, to provide a dispenser package for light-sensitive materials, e.g. films, longettes which has an erectable box containing a tubular foil which is received in the box and, in turn, receives the light-sensitive material to be dispensed. The box, which forms the outer member of the package, can have a lower box wall, an upper box wall and two generally parallel box side walls which are provided at both ends of the box with inwardly foldable side flaps.

The side flaps, in turn, can include a triangular segment which is connected via its base at a first fold line with the respective side wall or side panel of the outer box. A side of the triangle is connected laterally via a second fold line with a trapezoidal segment, an upper side of the trapezoidal segment being connected via a third fold line with a rectangular segment of the respective end flap.

The base of the trapezoidal segments is connected via a fourth fold line with a side of an underflap and the latter is connected via a fifth fold line with the end region of the lower panel of the box.

The box also has an upper flap which is connected via a sixth fold line with the end of the upper panel of the outer box.

A packaging of this type is associated with some disadvantages. For example, the tubular foil cannot always be made airtight after opening of a respective end of the box because the tubular foil is so associated with the end region of the outer box that its stiffness causes the tubular foil to resist reclosure.

OBJECTS OF THE INVENTION

It is, therefore, the principal object of the present invention to provide a dispenser package of the aforedescribed type which simplifies the airtight closure of the tubular foil.

Another object of this invention is to provide an improved packaging which is more reliable than packagings made heretofore, is less sensitive to damage, has a simplified reclosure mechanism and, generally, avoids drawbacks of prior art systems.

SUMMARY OF THE INVENTION

These objects and others which will become apparent hereinafter are attained, in accordance with the invention with a dispenser package for a light-sensitive product comprising:

an erectable outer box and a tubular protective foil received in the box and containing the product, the box comprising:

a lower panel;

an upper panel;

two substantially parallel side panels connecting the upper and lower panels along opposite longitudinal edges thereof;

respective inwardly foldable end flaps at opposite ends of the box and at each side panel, the end flaps including:

respective triangular segments having bases connected by respective first fold lines with the side panels, respective trapezoidal segments connected laterally to a respective side of a respective triangular segment by a second fold line, a respective rectangular segment connected by a third fold line to an upper side of each trapezoidal segment, a fourth fold line connecting a base of each of the trapezoidal segments with a respective under end panel, a respective fifth fold line connecting each under end panel with the lower panel, and a sixth fold line connecting an over end panel with the upper panel;

means at at least one end of the box connecting the respective over end panel with the two end flaps at the end of the box;

a seventh fold line substantially parallel to the sixth fold line subdividing the over end panel at the end of the box into two panel segments, the rectangular segments of the end flaps at the end of the box having side edges turned toward the upper panel and running between the panel segments; and a closed end of the foil extending from the end of the box upon closure thereof.

Specifically, therefore, on at least one end of the box, a) the upper flap is connected with the rectangular segments of the two side panels, b) the upper panel has a seventh fold line parallel to the sixth fold line and which extends between the side edges of the rectangle which are turned toward the box upper panel, and c) the closed end of the tubular foil projects from a closed end of the box.

With this configuration of the outer box, in combination with the tubular foil, the latter after opening can be shut airtight as is desirable whether this is done by a clamping bar yet to be described or it is done by hand controlled clamping without this closure process being hindered by the configuration of the outer box. As a consequence, light-sensitive liquid, pulverulent or strip materials, like, for example, liquid, powdered or strip materials, especially products which are several meters in length, can be folded into a meander configuration in the tubular foil and can be dispensed therefrom without any detrimental effect on the quality of the nonwithdrawn product resulting from the reclosure of the packaging.

According to a first embodiment of the invention, both ends of the outer box are provided with the features a, b and c as set forth above, although in a second embodiment only one end can have all three of these features while at the other end, the sides of the rectangular segments turned toward the upper flap can be separated from the upper flap somewhat as described in DE-AS-11 48 936.

Advantageously and, in accordance with a feature of the invention, an inner box or carton is provided in the outer box and the inner box can be erectable and can have a geometry similar to that of the outer box at least in cross section.

The inner box has at least one end in the region of its lower panel formed with a guide slit, whereby the lower wall of the inner box is arranged on the lower wall of the outer box. The slit apart from providing a guide function also has a retention or braking function for the withdrawn product.

When, for example, the product to be dispensed is a strip or web like product received in the tubular foil, for example, a longette, it is desirable to be able to withdraw this strip against the friction force provided by the guide slit but which should be so dimensioned that, on the one hand, easy withdrawal is insured but, on the other hand, an undesired retraction of the product into the interior of the package by, for example, its weight, is avoided. In the latter case, the user would be required to reach deep into the tubular foil to extract the product which is not only inconvenient and time consuming, but would also be detrimental to the sterility of a sanitary product when such a product is dispensed. In this case, it is desirable to provide the inner box within a tubular foil so that hydroscopic or moisture repelling products can be stored and the sterility better protected from the ambient atmosphere.

To this end, the inner box advantageously on its ends can be provided with an inwardly buckleable main flap and two lateral flaps buckling away therefrom, the main flap in the inwardly folded state forming with the bounding edge of the lower wall of the inner box, the aforementioned guide slit. The edges which define the guide slit of the inner box can be formed either with a waveshaped, sinusoidal, meander shape or a zig zag or sawtooth configuration which can be matched to the configuration of the material to be dispensed. To avoid damage to the closed end of the tubular foil which projects from the closed end of the outer box and to thereby increase the protection to the product to be dispensed, this end of the outer box can be covered by an inverted cover or cap whereby between the cover and the end of the outer box a clamping bar is provided to close the open tubular foil.

The projecting end of the tubular foil is advantageously closed by welding, embossing or adhesive bonding to the extent that, depending upon the dispensed product, the interior must be liquid and/or airtight. The outer and the inner box can be composed of paper or cardboard and the tubular foil formed by a water and/or air permeable synthetic resin.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
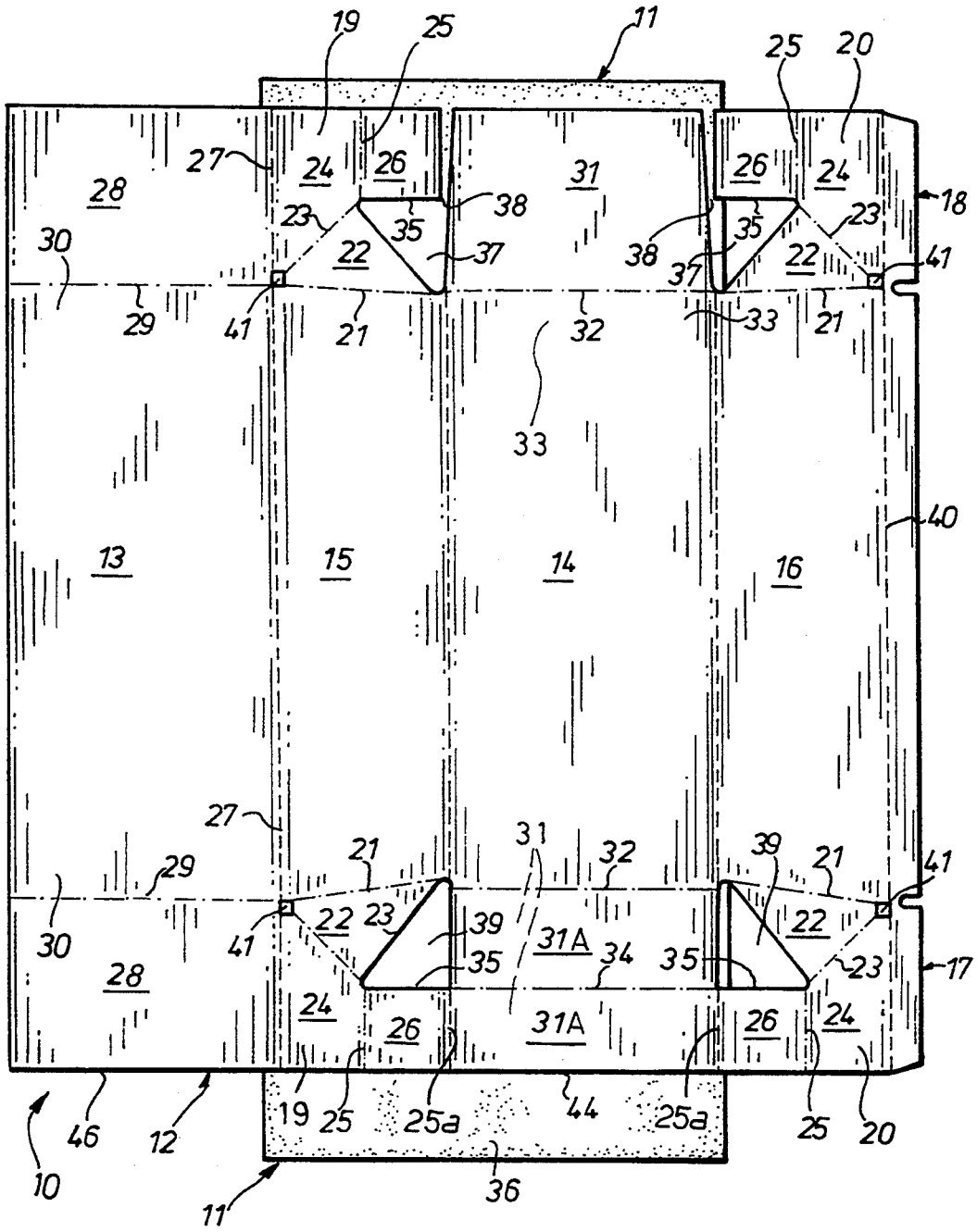
FIG. 1 is a plan view of the outer box blank prior to the erection and showing the tubular foil received below the box blank.

In FIG. 1, at the upper side of the blank 10 of FIG. 1, we have shown the end flaps and their relationship with the side flaps and panels and representing the prior art construction of the box or carton. The improvement according to the invention is shown at the lower side of the blank of FIG. 1 and, when both ends are provided with the improvement of the invention, the flap construction shown at the lower side in FIG. 1 will be understood to be duplicated at the upper side.

As can be seen from the upper side of FIG. 1, the outer box 12 of the package to receive a light-sensitive product, such as a film or a light-sensitive web which is to remain sterile, comprises a tubular foil 11 in the interior of which the dispensed product is received. The outer box 12 has a lower box panel or wall 13, an upper box panel or wall 14 and two generally parallel box side walls or panels 15, 16.

At the two ends 17, 18 (see also FIG. 2) the side panels 15, 16 are provided with inwardly foldable side flaps 19, 20 which are each connected at a respective triangular segment 22 via its base with a fold line 21 to the respective side panel 15, 16.

A second fold line 23 connects one side of the triangular segment 22 with a trapezoidal segment 24 and a third fold line 25 connects the upper side of the trapezoidal segment 24 with a rectangular segment 26.

The base of the trapezoidal segment 24 is provided via a fourth fold line 27 with one side of the lower flap 28 and the latter is connected by the fifth fold line 29 with the end region 30 of the lower panel 13 of the outer box 12.

An upper flap 31 is connected via a sixth fold line 32 with the end region 33 of the upper panel 14. This type of construction corresponds to that found in DE-AS 11 48 936.

The features of the invention can be seen at the lower half of FIG. 1. Here at the end 17 of the box 12, the upper flap 31 is connected with the rectangular segments 26 of the two side flaps 19 and 20. In addition, the upper flap 31 is here provided with a seventh fold line 34 parallel to the sixth fold line 32, the seventh fold line 34 being disposed between the side edges 35 of the rectangular segment 26 of the side flaps 19, 20 turned toward the upper panel 14. Finally, the end 36 of the tubular foil 11 in the closed state of the end 17 projects therefrom.

Because of the described configuration of the rectangular segment 26, the trapezoidal segment 24 and the triangular 22 with the fold lines 21, 23 and 25 at the end 18 of the box shown in FIG. 1 there is a triangular cutout or free space 37 which opens at a location 38. At the end 17 triangular free space or cutout 39 is provided which is completely closed. In addition, to allow the inward foldability of the side flaps 19, 20 at the ends 17 and 18 (with the end of the foil projecting from the end 18) square cutouts 41 are provided in the corner regions between the fold lines 27 and 21 on the one hand and the fold lines 21 and 20 on the other. In the perspective view of FIG. 2 all of the parts of FIG. 1 are shown with the same reference numerals.

Figure 2:
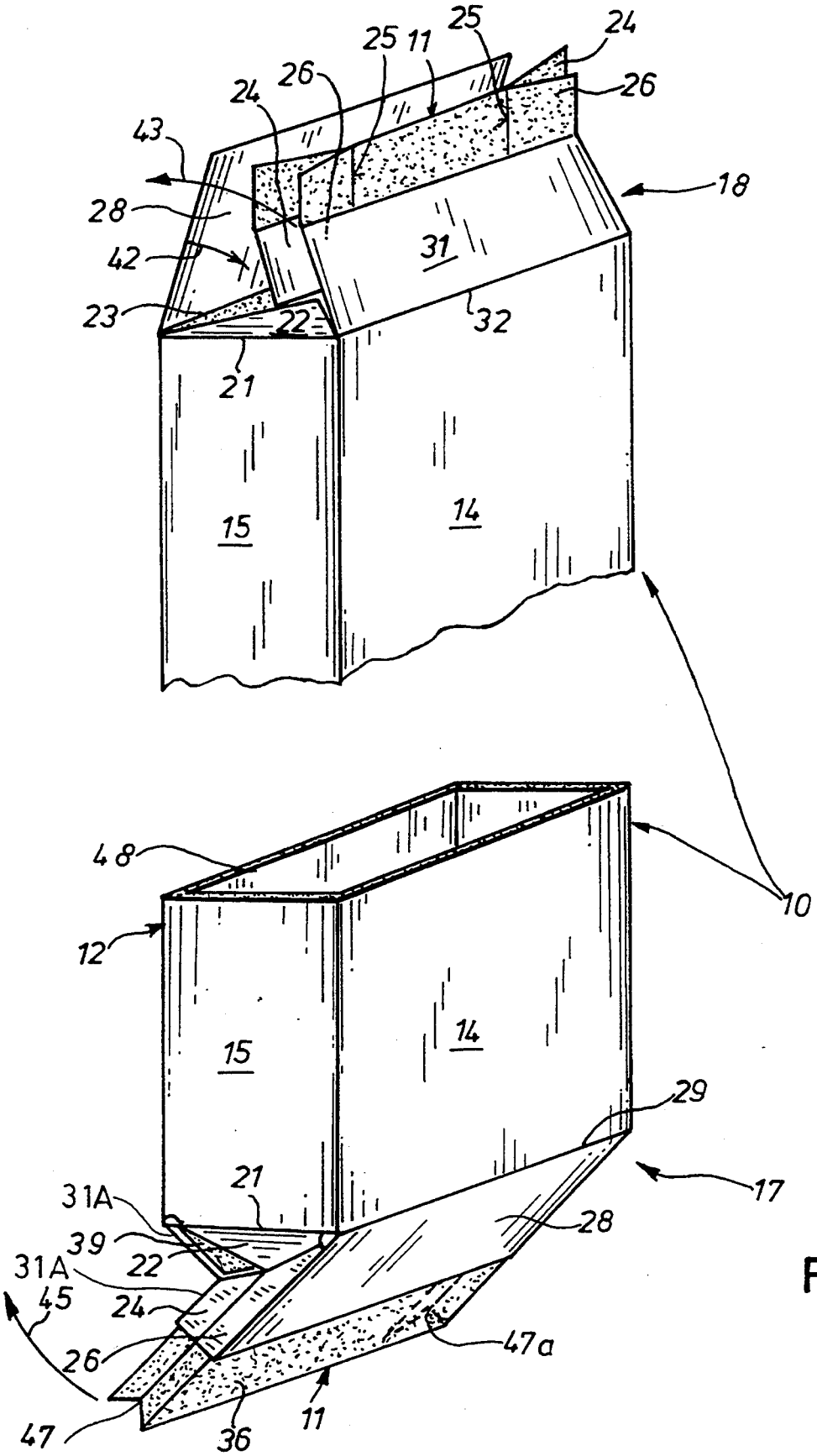
FIG. 2 is a perspective view of the outer box showing the inwardly folded side flaps but with the end of the package partly broken away and not completely closed.

The upper part of FIG. 2 shows the folding at the end 18 which forms the bottom of the package. As will be apparent here, the lower flap 28 is swung in the direction of arrow 42 about its fold line 29 which is not visible in this FIG., against the end of the rectangle formed by the end edges of the panels 15, 16 and the upper panel 14 and formed by the fold line 29. Only then is the upper flap 31 folded in the direction of arrow 43 about the fold line 32. The lower flap 28 is either completely covered or practically completely covered. After this folding, the tubular folding 11 which is trapped in these flaps, is no longer visible.

At the end 17 shown in the lower part of FIG. 2, i.e. the dispensing end, a corresponding folding is carried out. Here, however, the upper flap 31 is not only folded about the fold line 32 but is also folded about the fold line 34 so that two partial flaps 31A are formed between respective eighth fold lines 25*a* of the rectangular segments 26. The end edge 44 of the upper flap 31 is parallel to the fold line 32 and the fold line 34 is shifted inwardly toward the lower flap 28.

When the lower flap 28 is then folded in the direction of the arrow 45 shown at the bottom of FIG. 2, its end edge 46 (FIG. 1) assumes a position which is parallel to the fold edge 32 of the upper flap 31.

Figure 3:
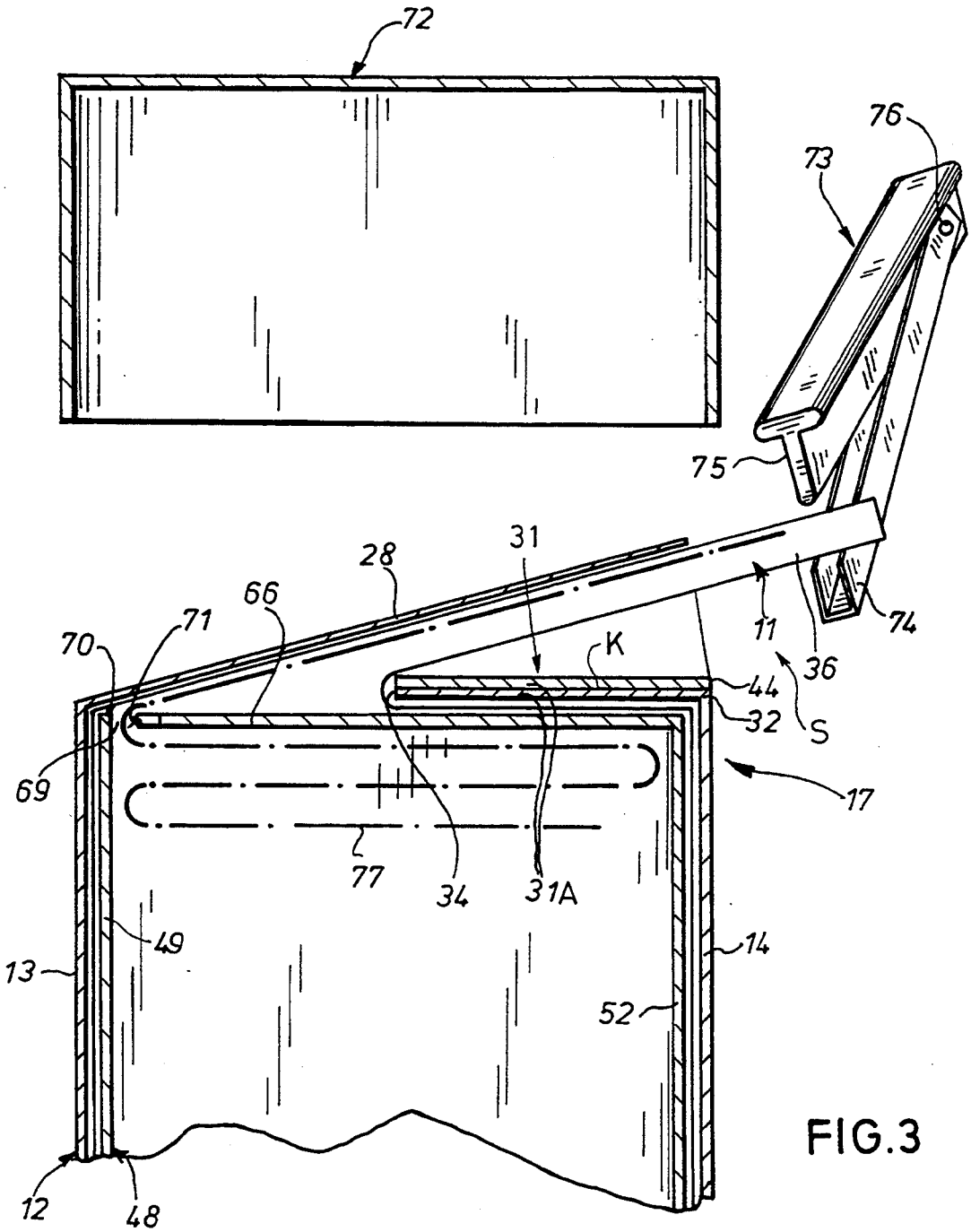
FIG. 3 is a more diagrammatic cross sectional view, drawn to a larger scale and taken generally along the line III—III of FIG. 6 showing the inverted cover lifted away and the clamping bar in a perspective view.

In this folded position, the closed end 36 of the tubular foil 11 projects beyond the flaps as is visible from FIGS. 2 and 3 and thus extends from the package 10. The fold line 34 can also be formed as a perforated line to insure complete folding of the two partial flaps 31A flat against one another.

Figure 6:
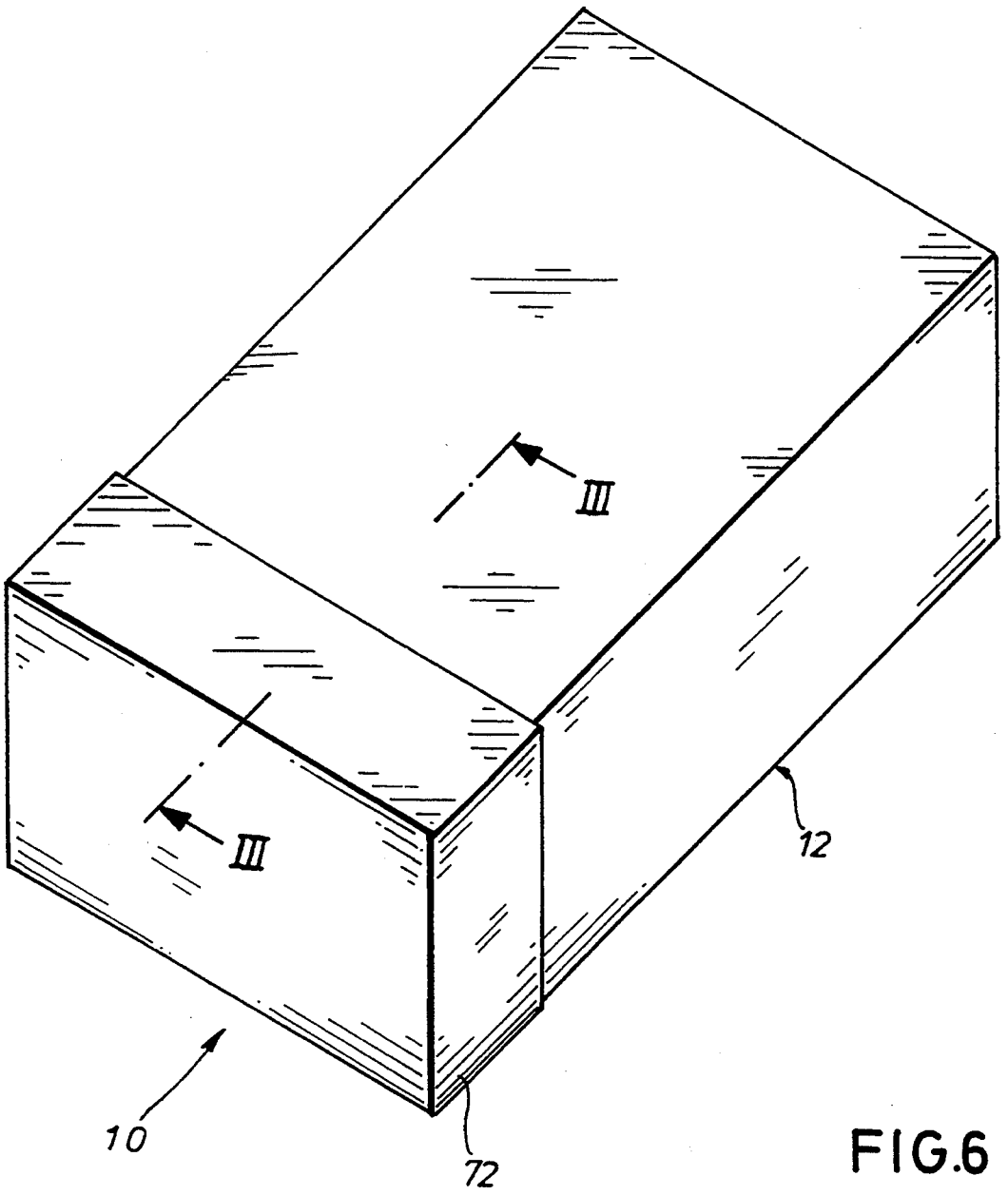
FIG. 6 is a perspective view of the package with the inverted cap applied to the outer box.

A lateral section along the line III—III of FIG. 6 is represented in FIG. 3 at the closed end 36 of the tubular foil. Here again the same reference numerals are used as those of FIGS. 1 and 2. Because of the folding in of the side flaps 19 and 20, the inwardly folded fold lines 23 and 25 (visible in FIG. 1 but not in FIG. 2) the closed end 36 of the tubular foil is flanked on both sides by the side flaps 19, 20 with the folds 47 and 47*a* (FIG. 2).

From FIG. 3, it is expressly clear that a dispensing mouth S is formed by the folding of the partial flaps 31 flat against one another and the bonding thereof by an adhesive K between them.

Figure 4:
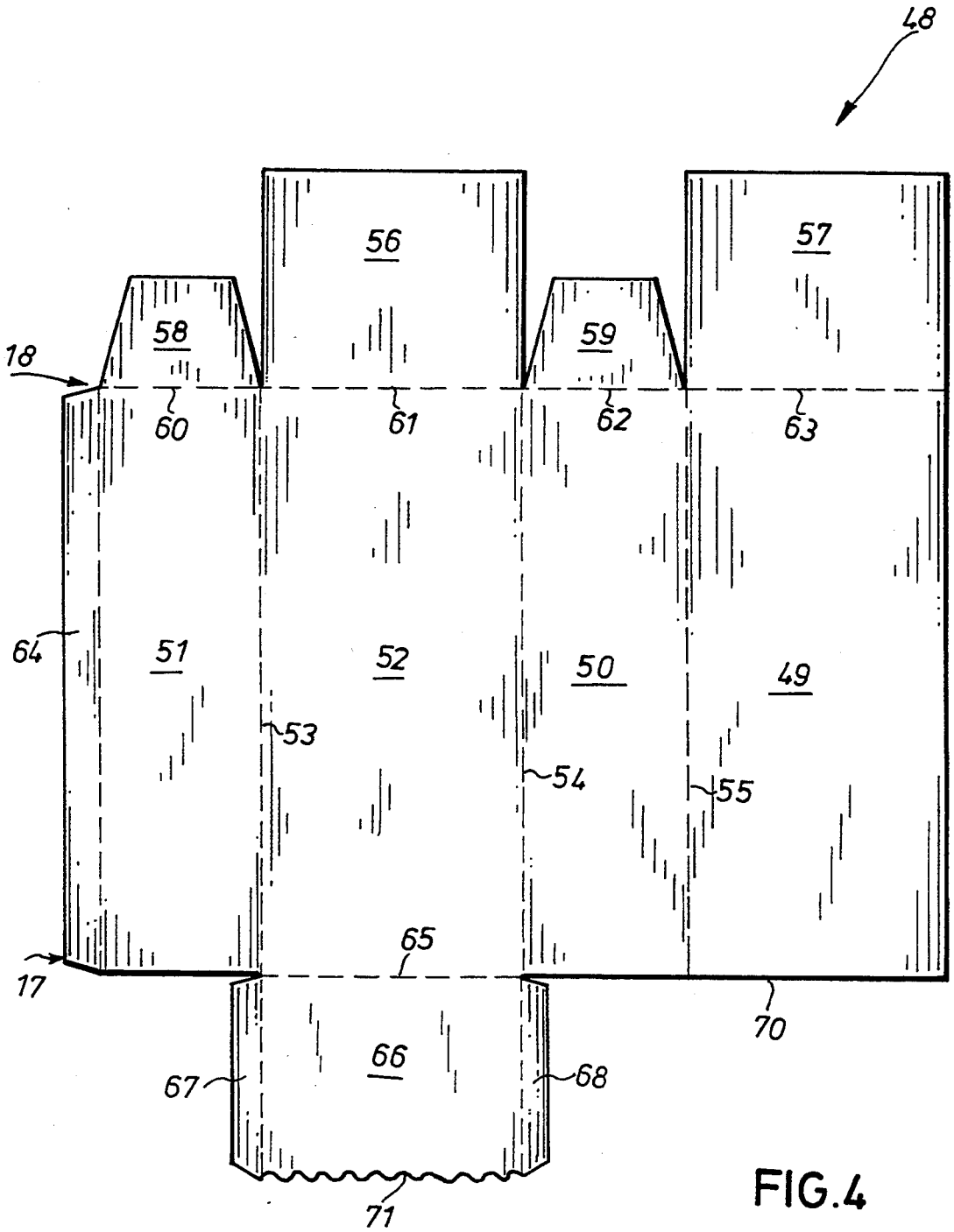
FIG. 4 is a plan view of the inner box blank.

According to a feature of the invention, within the outer box 10 an inner box 48 is provided which, in its erected position has a cross section which is geometrically similar to that of the outer box. The plan view on the outer side of this blank is shown in FIG. 4 and a perspective view of the erected inner box 48 is illustrated in FIG. 5.

This inner box 48 comprises an erectable tubular structure in the interior of which the tubular foil 11 can be received. It comprises a lower wall 49, 2 mutually parallel side walls 50, 51 and an upper wall 52.

The inner box side walls 50 and 51 are connected with the inner box upper wall 52 and the inner box lower wall 59, by fold lines 53 to 55. At the end 18 of the outer box, the inner box 48 is provided with an upper flap 56, a lower flap 57 and two side flaps 58, 59 which are foldable at approximately a right angle to the fold lines 60 to 63. A longitudinal side flap 64 serves to connect the lower flap 49 with the corresponding side wall to allow the inner box 48 to be erected into a tubular rectangular inner structure.

Figure 5:
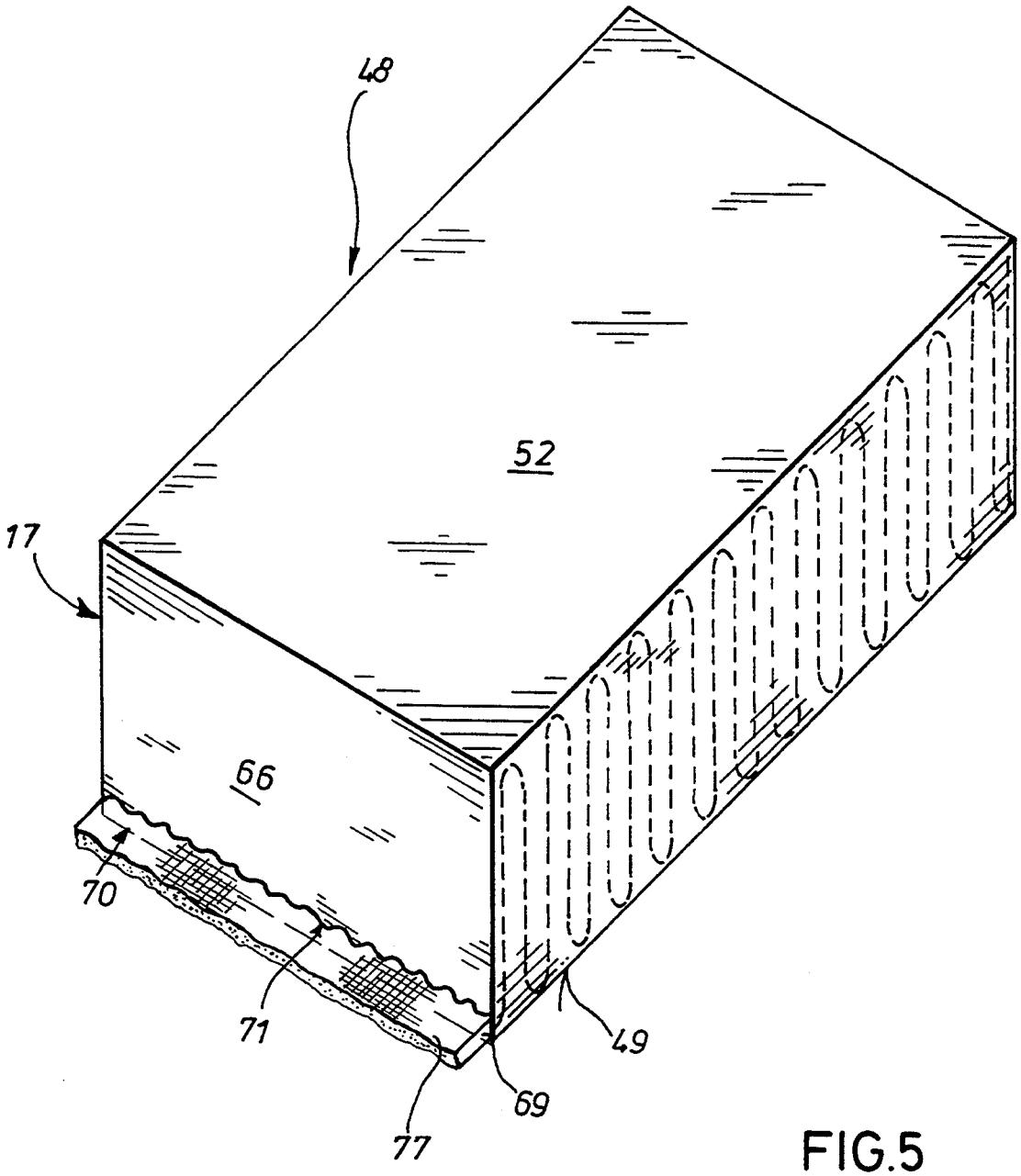
FIG. 5 is a perspective plan view of the closed inner box with its guide slit in the region of its lower panel.

At the end corresponding to the end 17 of the outer box, a foldable upper flap 66 has a fold line 65 and is provided in combination with two small side flaps 67 and 68 defining a guide slit 69 (see FIGS. 3 and 5).

This feed slit 69 is formed in the region of the inner box lower wall 49 so that upon insertion of the inner box 48 with the tubular foil 11 in the outer box 12, the lower wall 49 of the inner box is disposed upon the lower wall 13 of the outer box which will be apparent from FIG. 3.

The end 17 of the outer box 12 and the corresponding end of the inner box and the corresponding ends of the outer box 12 and the outer box 48 coincide.

From FIGS. 4 and 5 it will be apparent that the inner box 48 at its end 17 is foldable at the main flap 66 and two side flaps 67 and 68 provided thereon, the main flap 66 in the inwardly folded position (see FIG. 5) forming the guide slit of the inner box lower wall 49 at its bounding edge 70.

The edge 71 of the main flap 66 of the inner box 48 turned toward the box slit 48 can be provided with a wave configuration. It can be sinusoidal, meandering or a zig zag shape, depending upon the material to be dispensed which, as can be seen from FIGS. 3 and 5, can be a longette 77 which is folded in a meander pattern in the inner box and thus can be paid out through the extension of the foil line 11 and mouth of the inner box.

As is apparent from FIG. 3, therefore, the end 36 of the tubular foil 11 at the end 17 of the outer box can be covered by an inverted cap 72 and the extension 36 can be sealed by welding embossing or an adhesive.

Between the inverted cover 72 and the end 17 of the outer box 12, a clamping bar 73 can be provided to close the end 36 of the tubular foil 11 after an opening thereof.

The clamping bar 73 shown in perspective view in FIG. 3 comprises substantially a U-section lower bar 74 and a T-section upper bar 75 which is connected thereto via a pivot 76 and is so disposed that the open end 36 of the tubular foil 11 can be laid in between these bars.

The clamping bar 73 not only seals the end 36 so that it is air and liquid tight, but also provides a mechanically stable seal which is highly reliable.

The outer box 12 and the inner box 48 are advantageous composed paper while the tubular foil 11 and the clamping bar 73 can be composed of an alkali and/or acid resistance synthetic resin foil which is permissible to water and/or air.

The basic element of the structure of the invention, therefore, comprises:

- an erectable outer box 12 and a tubular protective foil 11 received in the box and containing the product, the box comprising:
  - a lower panel (13);
  - an upper panel (14);
  - two substantially parallel side panels (15,16) connecting the upper and lower panels (13,14) along opposite longitudinal edges thereof; respective lower and upper foldable flaps (28, 31);
- respective inwardly foldable end flaps at opposite ends of the box and at each side panel (15,16), the end flaps including:
  - respective triangular segments (22) having bases connected by respective first fold lines (21) with the side panels (15,16),
  - respective trapezoidal segments (24) connected laterally to a respective side of a respective triangular segment (22) by a second fold line (23),
  - a respective rectangular segment (26) connected by a third fold line (25) to an upper side of each trapezoidal segment (24), and a fourth fold line (27) connecting a base of each of the trapezoidal segments (24) with a respective lower flap (28), a respective fifth fold line (29) connecting each lower flap (28) with the lower panel (13), and a sixth fold line (32) connecting an upper flap (31) with the upper panel (14);

means at at least one end of the box connecting the respective upper flap with the two end flaps at the end of the box;

a seventh fold line (34) substantially parallel to the sixth fold line (32) subdividing the upper flap (31) at the end of the box into two panel segments (31A), the rectangular segments (26) of the end flaps at the end of the box having side edges turned toward the upper panel (14) and running between the panel segments; and a closed end (36) of the foil (11) extending from the end of the box upon closure thereof.

We claim:

1. A dispenser package for a light-sensitive product, comprising:

an erectable outer box and a tubular protective foil received in said box and containing said product, said box comprising:

a lower panel;

an upper panel;

two substantially parallel side panels, one of said side panels connecting said upper and lower panels along opposite longitudinal edges thereof, the other of said side panels being connected to said upper panel along a longitudinal edge thereof;

respective lower inwardly foldable flaps at opposite ends of the lower panel and at opposite ends of said outer box;

respective upper inwardly foldable flaps at opposite ends of the upper panel and at opposite ends of said outer box;

respective inwardly foldable end flaps at opposite ends of said outer box and at each side panel, each of said end flaps including:

a respective triangular segment having a base connected by a respective first fold line with the respective one of said side panels, a respective trapezoidal segment connected laterally to a respective side of a respective triangular segment by a second fold line, and a respective rectangular segment connected by a third fold line to an upper side of each trapezoidal segment;

a fourth fold line connecting a base of each of said trapezoidal segments of the end flaps of said one of said side panels with a respective lower foldable flap;

each of said lower foldable flaps being provided with a respective fifth fold line connecting each lower flap with said lower panel;

each of said upper foldable flaps being provided with a respective sixth fold line connecting each upper flap with said upper panel;

means at at least one of said ends of said outer box for connecting the respective upper flap with the two end flaps at the said one end of said outer box;

a seventh fold line substantially parallel to said sixth fold line subdividing said upper flap at said one end of said outer box into outer and inner rectangular panel segments, each of the rectangular segments of the end flaps at said one end of said outer box being formed with a respective eighth fold line extending perpendicular to the seventh line, said eighth fold lines delimiting between them the outer panel segment of said upper flap of said one end of said outer box, said outer panel segment being folded over said inner panel segment along the seventh fold line upon erecting the dispenser package; and a closed end of said foil extending from said one end of said outer box upon closure thereof.

2. The package defined in claim 1 wherein the other end of said outer box opposite said one end is provided with a respective other of said upper flaps flanked by the respective rectangular segments of the two side flaps formed at said other end of said outer box, and said foil extends from both of said opposite ends of said outer box upon closing thereof.

3. The package defined in claim 1 wherein said upper flap formed on the other end of said box is separated from the respective sides of the rectangular segments of the two side flaps facing said upper flap.

4. The package defined in claim 1 wherein said outer and inner panel segments formed at said one end of said outer box and lie flat against one another upon folding and are adherently bonded together.

5. The package defined in claim 1, further comprising an inner box formed in the outer box, said inner and outer boxes having respective cross-sections similar to one another.

6. The package defined in claim 5 wherein the inner box has at least one end having a lower wall and juxtaposed with the lower panel of the outer box to sandwich said foil therebetween.

7. The package defined in claim 6 wherein the inner box has an inwardly foldable main flap at at least one of opposite ends thereof, said main flap having an inwardly folded position and forming with a bounding edge of said lower wall of said inner box a guide slit through which said foil extends.

8. The package defined in claim 7 where said guide slit is defined by at least one contoured edge selected from the group which consists of wave length, sinusoidal, meander shaped or zig zagged edges.

9. The package defined in claim 1 further comprising an inverted cover fitted over said one end of said outer box.

10. The package defined in claim 1 further comprising an inverted cap covering said one end of said outer box.

11. The package defined in claim 1 wherein said closed end of said foil extending from said one end of said outer box is sealed.

12. The package defined in claim 1 wherein said box is composed of paper and said foil is an acid and alkali resistant water and air impermeable synthetic resin.

* * * * *